United States Patent [19]

Foller

[11] Patent Number: 4,541,989

[45] Date of Patent: Sep. 17, 1985

[54] PROCESS AND DEVICE FOR THE GENERATION OF OZONE VIA THE ANODIC OXIDATION OF WATER

[75] Inventor: Peter C. Foller, Berkeley, Calif.

[73] Assignee: Oxytech, Inc., Cupertino, Calif.

[21] Appl. No.: 461,575

[22] Filed: Jan. 27, 1983

[51] Int. Cl.[4] ..... C01B 13/11; B01J 19/08

[52] U.S. Cl. ..... 422/186.07; 204/176; 261/DIG. 42; 422/186.18

[58] Field of Search ..... 422/186.20, 186.19, 422/186.18, 186.11, 186.07, 186.12; 204/164, 176, 232; 252/62.2

[56] References Cited

U.S. PATENT DOCUMENTS

| | | | |
|---|---|---|---|
| 2,089,793 | 8/1937 | Hartman | 422/186.18 |
| 3,734,846 | 5/1973 | McNabney et al. | 422/186.20 |
| 3,739,440 | 6/1973 | Lund et al. | 422/186.18 |
| 3,899,685 | 8/1975 | Francis et al. | 422/186.11 |
| 3,963,625 | 6/1976 | Lowther | 422/186.11 |
| 4,048,668 | 9/1977 | Von Bargen et al. | 422/186.16 |
| 4,120,764 | 10/1978 | Torii et al. | 204/78 |
| 4,148,697 | 4/1979 | Torii et al. | 204/59 R |
| 4,351,734 | 9/1982 | Kauffman | 422/186.07 |

FOREIGN PATENT DOCUMENTS

| | | | |
|---|---|---|---|
| 3005040 | 7/1981 | Fed. Rep. of Germany | 422/186.18 |
| 0014188 | 2/1976 | Japan | 422/186.20 |
| 0034592 | 9/1977 | Japan | 422/186.19 |

*Primary Examiner*—Stephen J. Lechert, Jr.
*Assistant Examiner*—Howard J. Locker
*Attorney, Agent, or Firm*—Flehr, Hohbach, Test, Albritton & Herbert

[57] ABSTRACT

Electrolytic cell and method of use thereof is provided for the production of ozone. The cell comprises at least one inert glassy carbon, lead dioxide or platinum anode, and at least one air cathode for reducing oxygen and electrolyte comprising tetrafluoroborate anions.

8 Claims, 4 Drawing Figures

PROCESS AND DEVICE FOR THE GENERATION OF OZONE VIA THE ANODIC OXIDATION OF WATER

The present invention is directed to the production of ozone in electrolytic cells. In particular, the present invention is directed to an electrolytic process and cell whereby oxygen from air is cathodically reduced at an air electrode to form water, which in turn is decomposed at an inert anode to form ozone.

There are severe problems in economically manufacturing ozone at levels up to about 10 lbs. per day. Conventional corona discharge ozone generation equipment suffers from the disadvantage that extensive feed air pretreatment is required or pure oxygen feed must be utilized. Also, ozone concentrations much over 4%. per day are not economically obtainable by a corona discharge. Ultraviolet ozone generation technology is frequently used for capacity requirements of under 1lb. per day, however, such method suffers from the disadvantages of high power consumption and low ozone concentration, i.e., about 500 ppm and less.

It is therefore an object of the present invention to provide a method for producing ozone by electrolytic processes which utilize relatively inexpensive direct current power supplies.

It is a further object of the present invention to provide a method and cell for producing ozone by electrolysis which produces ozone at levels of up to 10 lbs. per day.

These and other objects of the invention will be readily apparent from the following description and claims.

The present invention is directed to electrolytic cells for the production of ozone comprising at least one anode comprising a material selected from glassy carbon, lead dioxide and platinum; at least one air cathode for reduction of oxygen; and electrolyte comprising tetrafluoroborate anions. A particularly preferred embodiment of the present invention is directed to a method of producing ozone from an electrolytic cell comprising a glassy carbon electrode and an electrolyte comprising tetrafluoroborate anions, wherein the electric current is passed into the cell through an air cathode to effect reduction of gaseous oxygen to water.

The electrolytic half reactions which take place in the cells according to the invention are as follows:

Ambient air is cathodically reduced to water in a concentrated acid electrolyte at a fuel-cell type electrode:

$$O_2+4H^++4e^-\rightarrow 2H_2O \quad (1)$$

The use of this cathodic process avoids the evolution of hazardous hydrogen gas. The corresponding anodic process decomposes the water to a mixture of ozone and oxygen by the following competitive reactions:

$$3H_2O\rightarrow O_3+6H^++6e^-, \quad (2)$$

and $$2H_2O\rightarrow O_2+4H^++4e^{31} \quad (3)$$

Figure 1:
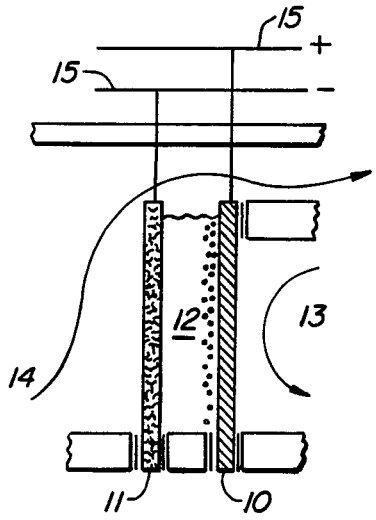
FIG. 1 is a general schematic of an electrolytic cell according to the present invention.

A general schematic of a cell employing the abovedescribed process is shown in FIG. 1. Generally, the cell is defined by inert anode 10 and air cathode 11, both of which are in contact with electrolyte-containing liquid 12. The anode 10 is cooled by flowing fluid coolant represented by 13, contacting the outer surface of anode 10. The air cathode 11 is fed by air flow represented by 14 which feeds air to the outer surface of cathode 11. The air flow continues flowing over the top of the electrolyte, mixing with the gaseous ozone evolving from the anode, to be collected by an appropriate collector (not shown). Current is directed into the electrodes through appropriate connectors 15.

According to the present invention, ozone current efficiency, defined as the fraction of current passed which goes to ozone formation (reaction 3) versus oxygen formation (reaction 2), may be obtained in the range of 30–35% at anode surface temperatures compatible with the flow of cooling water. At low power consumption current densities, such as approximately 400 milliamps per centimeter$^2$, ozone production of about 2 lbs. per square foot per day may be attainable.

The cells utilized in accordance with the present invention may be either of the flowing or static electrolyte type. In particular, it is preferred that the electrolyte be static and contained in a single vessel to reduce the possibility of leakage. Therefore, the cells may be suspended, for example, in an electrolyte tank. Furthermore, since the ozone output per cell according to the present invention is particularly high, few cells may be needed to produce ozonizers of the desired capacity range. Therefore, individual and interchangeable dual cells or concentric cylinder cells may be suspended in distinct but interconnected cell compartments in the electrolyte tank.

Figure 2:
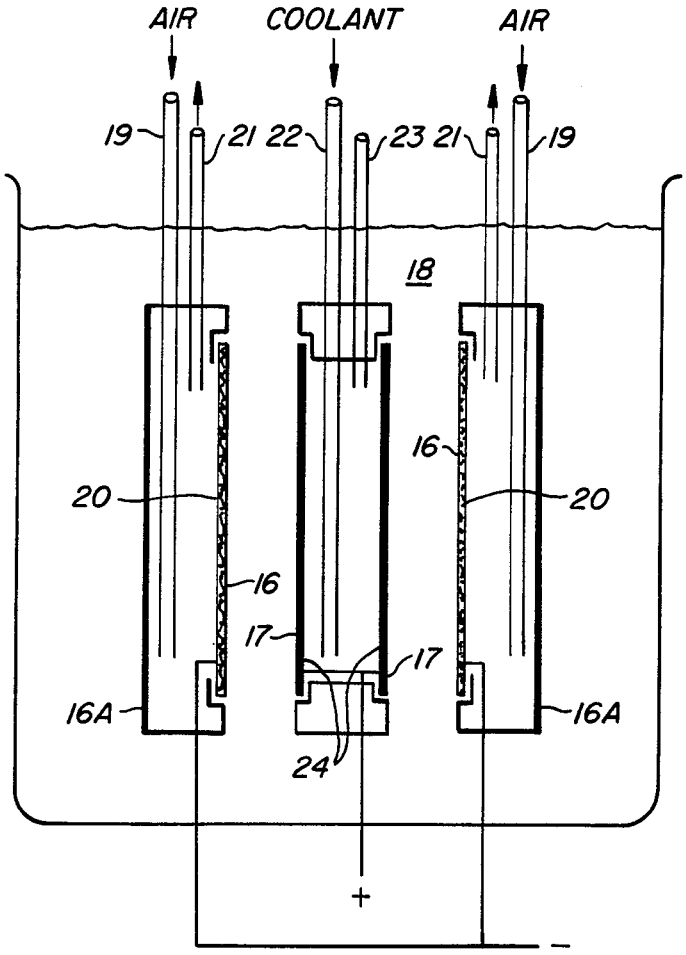
FIG. 2 is an electrolytic cell according to the present invention in a dual cell configuration.

Particular embodiments of such cells are shown in the accompanying figures. In FIG. 2, a dual cell configuration is shown utilizing air cathodes 16 and anodes 17. Each electrode is immersed in the electrolyte fluid 18. The interior of each air cathode assembly 16A comprises air chambers wherein air is introduced through inlets 19 to contact the inner cathodic surface 20. The air is exhausted through outlets 21. The interior of anode assembly contains liquid coolant which is introduced into the anode through inlets 22 and removed through outlet 23. The coolant cools the anodes by contacting the inner surfaces 24 of the anode material.

Figure 3:
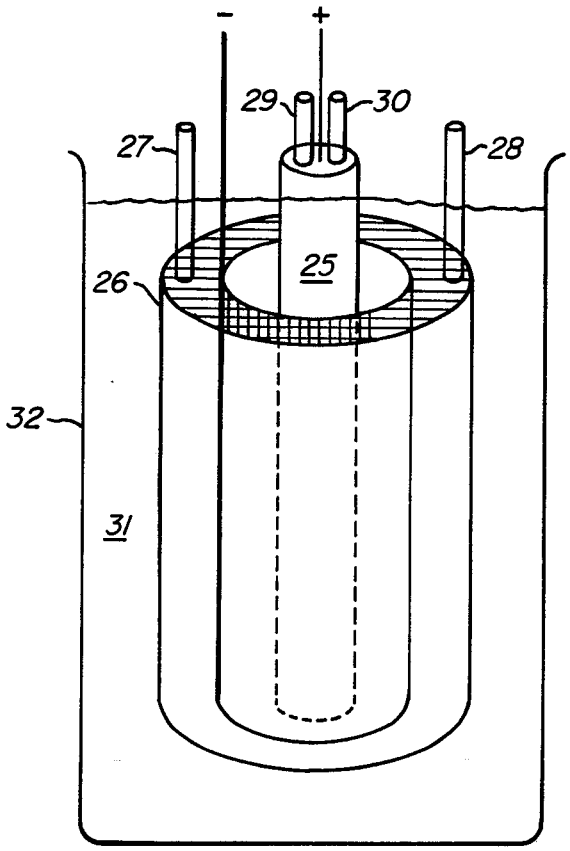
FIG. 3 is an electrolytic cell according to the present invention in a concentric cylinder configuration.

Referring to FIG. 3, there is shown a schematic of a concentric cylinder cell which contains a central tubular anode 25 surrounded by a concentric air cathode 26 into which air flows in through inlet 27 and out outlet 28. The anode coolant flows into the anode through inlet 29 and out through outlet 30. The electrodes are immersed in electrolyte 31 contained by tank 32.

Figure 4:
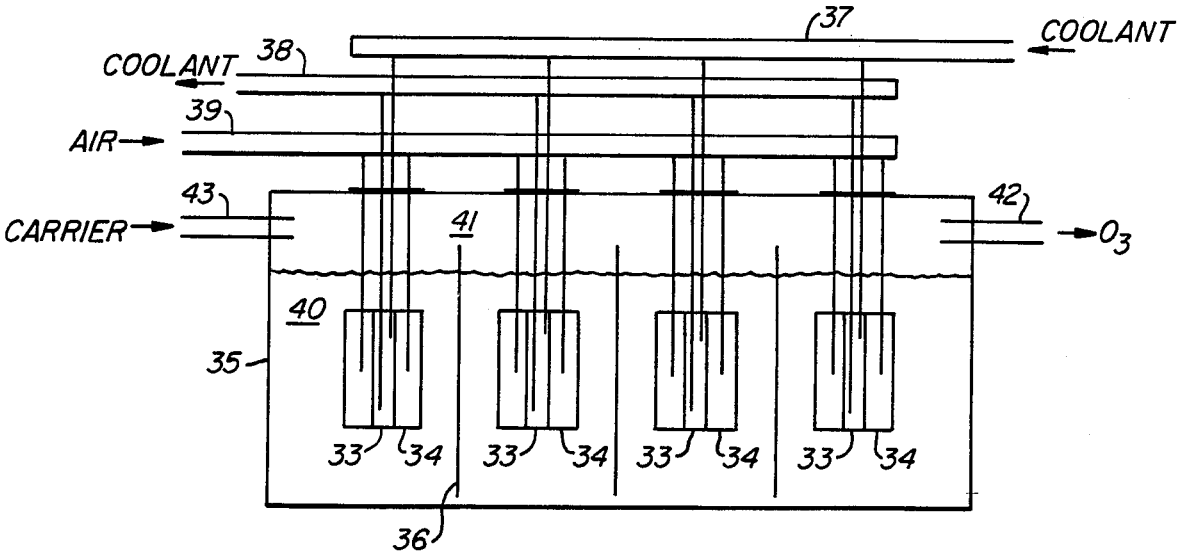
FIG. 4 is a multi-cell configuration of electrolytic cells according to the present invention.

A multi-cell device may combine either of the forms described in FIGS. 2 or 3 into a multi-cell unit providing for shunt current suppression, air humidification, ozone dilution with carrier gas, exit stream demisting and gas manifold. FIG. 4 shows such a multi-cell device utilizing the plurality of cells of a modified configuration of FIG. 3. Enclosed electrolyte tank 35 is shown accommodating a plurality of baffles 36 dividing the tank into several compartments. Each compartment contains a concentric cylinder cell having centrally located anodes 33 and concentric air cathodes 34. Each anode is cooled from coolant entering through manifold 37 and exiting manifold 38. Feed air is fed into the cathode through manifold 39. In this alternate configuration there is not a specific air outlet manifold provided for the cathodes, so that the air remains within the cathode air chambers. Some of the air may then be bubbled into the electrolyte 40 through the cathodes diluting the ozone gas (not shown) which is formed at the surface of the anodes 33. The excess air and ozone product accumulate in the upper chamber 41 of tank 35 and may be withdrawn through vent 42. The ozone is appropriately diluted with a carrier gas which enters into the upper compartment 41 through vent 43. Appropriate electrical connections with the anodes and cathodes (not shown) may be provided in any convenient manner.

Numerous advantages are attained by the above described cell designs. The individual cells are interchangeable and may be removed for periodic electrode replacement.

Also, the electrolyte tank may be fully enclosed, thereby minimizing the possibility of leakage of electrolyte.

Mechanical agitation of the electrolyte is not required since circulation is provided through natural convection caused from bubble lift. The problem of leakage from the air cathodes may be handled by accommodating the bottom of the air chamber with holes through which the leakage may be blown. Cooling water may be utilized to humidify feed air to suppress electrolyte evaporation. Additionally, particularly with the concentric cylinder design shown in FIG. 3, since the cathode area is larger than the anode area the cathodes may be run at a current density of approximately ½ of that of the anode, thereby reducing power consumption due to polarization losses at the cathode and increasing cathode life. Also the centrally located tubular anode in FIG. 3 may be internally cooled by high flow rates of coolant, while the larger cathode dissipates heat by air flow.

The anode materials utilized in accordance with the present invention may be selected from the materials glassy carbon, lead dioxide, or platinum. Preferably, the anodes are made of glassy carbon. Particularly preferred glassy carbon electrodes are disclosed by Foller et al. in Ser. No. 263,155, filed May 21, 1981, the disclosure of which is incorporated herein by reference in its entirety. Glassy carbon is preferred since it is resistant to oxidative processes and to anion penetration due to its random, yet fully coordinated structure. Glassy carbon may be made by heat treating certain resins under controlled inert atmospheric conditions. For example, the resins may be baked at temperatures of between 300 and 3,000° C. A preferred firing temperature range is from 500–1,000° C. Glassy carbon plates and tubes 2–3 centimeters in diameter and 2–3 millimeters in thickness are commercially available. Such glassy carbon electrodes may be metallized on the coolant side to improve conductivity and current distribution.

The air cathodes utilized in accordance with the present invention are particularly advantageous since they allow for a lower voltage to be applied per cell, thereby saving energy and they eliminate the evolution of hydrogen, which is a potentially explosive gas. Furthermore, the production of water maintains the electrolyte solution composition, thereby eliminating the need for periodic water addition, as would be the case if hydrogen were to be formed at the cathode instead of water. Air cathodes are well known in the fuel cell industry and are commercially available. For example, air cathodes are available from United Technologies, Westinghouse and Diamond Shamrock. To adapt the air cathode for operation in a tetrafluoroborate electrolyte, it is preferred that the interior of the air cathode is designed for at least 6 inches of a water air bubble pressure to prevent air chamber flooding. It is also preferred that the air cathodes operate at a high rate, i.e., at least about 300 milliamps per centimeter$^2$, at ambient temperatures. Operation at ambient temperature will normally require that the active layer be designed to accommodate the hydrophobicity and catalyst content necessary for ambient temperature. Most commercial air cathodes are designed to operate at elevated temperatures due to the poor oxygen reduction kinetics. Therefore, the air cathode may be modified for operation at ambient temperature by using the highest possible level of platinum catalysis.

The air cathodes also require a metallic substrate for conductivity. It is desirable that the substrate be inert to corrosion in the tetrafluoroborate anion containing electrolyte, which will conventionally be tetrafluoroboric acid. Usually, the substrate may be formed by noble metal plating of conventional highly conductive materials, such as silver or nickel. A small protective current of from 1–10 milliamps per centimeter$^2$ may be required when the ozone generator is shut down to prevent corrosion or change in the characteristics of the air/electrolyte interface within the partially hydrophobic porous cathode structures.

The electrolyte utilized in accordance with the present invention comprises tetrafluoroborate anions, usually provided in the form of tetrafluoroboric acid. Utilizing glassy carbon anodes, it is preferable that the electrolyte comprise 48% by weight of acide, which is the highest concentration commercially available. Tetrafluoroboric acid itself may be prepared by dissolving $B_2O_3$ or $B(OH)_3$ in an aqueous solution of 70% hydrogen fluoride. Alternatively and preferably, anhydrous hydrogen fluoride gas may be used and reacted directly with $B_2O_3$ or $B(OH)_3$ to prepare an acid of higher concentration than a commercial grade. Higher ozone current efficiencies may be thereby obtained although conductivity may be somewhat reduced by using concentrations higher than 48% by weight tetrafluoroboric acid.

A particular advantage of the cells according to the present invention is that the ozonizers may be made compact and therefore are useful in such applications as swimming pool sanitization, control of bio-fouling in air conditioning cooling towers, industrial waste treatment applications, i.e., such as phenol, pesticide, cyanide, dye waste, and heavy metals. Further uses include use in bottling and maintaining potable water quality in remote sites, reprocessing aquaria water, odor control or disinfection of sewage. Many of such applications are currently not performed using ozone due to the high cost of ozonizers heretofore known, air preparation or oxygen feed costs and low concentration output.

Having described the invention in the above specification and the specific embodiments, the following example is provided for the purpose of illustration and is not intended to limit the invention.

EXAMPLE

An ozonizer is constructed having the following characteristics: the cell stack comprising 4 cells, each with 100 centimeter$^2$ glassy carbon anode area; power is provided to the cell at 16 v at 80 amps (90% efficient). Total ozone production is 1.76 lbs. per day. Power consumption is 21.8 killowatts per lb. ozone at 4 v per cell (unoptimized). The dimensions of the cell and the ozone output concentration are provided below.

Ozone Concentration

| Volume % | liter/min output |
|---|---|
| 18.8 | 1.0 |
| 5.77 | 2.0 |
| 2.10 | 5.0 |
| 1.02 | 10.0 |

Size

Electrolyte containment vessel: 9″×9′×12″
Power Supply: 6″×6″×9″
Overall: 12″×12″×18″

We claim:

1. An electrolytic cell for the production of ozone comprising: at least one anode comprising a material selected from glassy carbon, lead dioxide and platinum; at least one air cathode for reduction of oxygen; and aqueous electrolyte comprising tetrafluoroborate anions wherein said anode and said cathode are in contact with said electrolyte, and air is in contact with said cathode whereby during operation of said cell ozone is formed by oxidation of water at the surface of said anode and water is formed by reduction of oxygen at the surface of said cathode.

2. A cell according to claim 1 wherein said anode comprises glassy carbon.

3. A cell according to claim 2 comprising at least one anode assembly, said assembly comprising at least one anode and defining an interior compartment accommodating a coolant separated from said electrolyte.

4. A cell according to claim 3 comprising at least one cathode assembly, said assembly comprising at least one catalytic cathode for reduction of air to water and defining an interior compartment accommodating air separated from said electrolyte.

5. A cell according to claim 4 wherein each said anode assembly comprises two anodes and each said cathode assembly comprises two catalytic cathodes.

6. A cell according to claim 4 wherein said anode assembly is of a tubular configuration concentrically disposed within a tubular cathode assembly.

7. A cell according to claims 5 or 6 wherein a plurality of said cathode assemblies and anode assemblies are immersed within an electrolyte-container vessel whereby ozone evolution into said electrolyte induces convection currents to facilitate ozone bubble removal from the surfaces of said anodes.

8. A cell according to claim 4 wherein an orifice is provided at the bottom of said interior compartment of said cathode assembly through which fluids may be expelled by air pressure within said compartment.

* * * * *

UNITED STATES PATENT AND TRADEMARK OFFICE

CERTIFICATE OF CORRECTION

PATENT NO. : 4,541,989

DATED : September 17, 1985

INVENTOR(S) : Foller

It is certified that error appears in the above—identified patent and that said Letters Patent is hereby corrected as shown below:

In column 4, line 39, change "acide" to "acid".

Signed and Sealed this

*Tenth* Day of *June 1986*

[SEAL]

*Attest:*

DONALD J. QUIGG

*Attesting Officer*

*Commissioner of Patents and Trademarks*